United States Patent [19]

Suzuki et al.

[11] 4,112,661

[45] Sep. 12, 1978

[54] OPEN-END SPINNING MACHINE AND A METHOD OF STOPPING THE SAME

[75] Inventors: Yoshihisa Suzuki, Nagoya; Katuaki Sugiura, Okazaki; Osamu Suzuki, Obu; Ichiro Tashiro, Nagoya, all of Japan

[73] Assignee: Kabushiki Kaisha Toyoda Jidoshokki Seisakusho, Japan

[21] Appl. No.: 787,760

[22] Filed: Apr. 15, 1977

[51] Int. Cl.[2] ..... D01H 1/12; D01H 13/16; D01H 15/00

[52] U.S. Cl. ..... 57/34 R; 57/58.89; 57/80; 57/156

[58] Field of Search ..... 57/34 R, 58.89–58.95, 57/78, 79, 80, 81, 110, 106, 156

[56] References Cited

U.S. PATENT DOCUMENTS

| | | | |
|---|---|---|---|
| 3,354,626 | 11/1967 | Cizek et al. | 57/78 |
| 3,541,774 | 11/1970 | Sterba et al. | 57/81 X |
| 3,670,484 | 6/1972 | Brazda et al. | 57/58.89 X |
| 3,678,673 | 7/1972 | Prochazka et al. | 57/34 R X |
| 3,695,017 | 10/1972 | Hori et al. | 57/81 X |
| 3,733,799 | 5/1973 | Roethke | 57/81 X |
| 3,749,327 | 7/1973 | Roethke et al. | 57/34 R X |
| 3,939,638 | 2/1976 | Bruckert et al. | 57/58.89 X |
| 4,020,622 | 5/1977 | Lattion | 57/58.89 X |

*Primary Examiner*—Donald Watkins
*Attorney, Agent, or Firm*—Burgess, Ryan and Wayne

[57] ABSTRACT

Disclosed is an open-end spinning machine and a method of stopping the same. The machine comprises: feed rollers, for supplying fibers to a combing roller, connected to a main power source via a clutch; a spinning rotor, for collecting the fibers combed by the combing roller into a yarn and for twisting the yarn, connected to another power source via a clutch; a draw off roller and a press roller urged toward the draw off roller, for withdrawing the yarn from the spinning rotor, connected to the main power source via an endless driving belt and to a brake; a traverse guide, for traversing the withdrawn yarn along a bobbin supported by a pair of cradle arms, connected to the main power source via a clutch and to a brake; a winding drum, for frictionally driving the bobbin to wind the yarn around the bobbin and form a cheese, connected to the main power source and; a controlling device, for controlling the brakes and clutches according to a predetermined program, by which the traverse guide is stopped when both the feed rollers and the spinning rotor are turned off, but before both the draw off rollers and the winding drum are stopped. By utilizing this machine and method, the number of yarn breakages occurring during the starting operation is decreased.

8 Claims, 3 Drawing Figures

PB2
PB1
cr5
OL
MS
ms-1
T1
T2
t2
t1
CR 1
T3
t3
CR 2
cr2-1
T4
t4
CR 3
cr3-1
T5
t5
CR 4
cr4-1
ms-2
t7
CR 5
T6
t6
CR 6
cr6-1
T7
cr1-1
cr3-2
52C
cr2-2
cr5-1
53C
cr3-3
cr6-2
51C
cr4-2
cr5-2
54C
cr5-3
62B
63B
cr6-3
61B
ms-3
cr1-2

OPEN-END SPINNING MACHINE AND A METHOD OF STOPPING THE SAME

SUMMARY OF THE INVENTION

The present invention relates to an improved open-end spinning machine utilizing a quick yarn traverse winding system, called a QT system, and to a method of stopping the same.

In practical mill operations the open-end spinning machines are usually stopped during non-operating hours of the mill, in addition, in some cases, an open-end spinning machine is stopped when a yarn breakage is detected so as to repair the broken yarn. In such cases, it is required that the open-end spinning machine be easily restarted.

To facilitate easy restarting of an open-end spinning machine, many stopping methods have been proposed. For example, a usual method for stopping a conventional open-end spinning machine is to first stop the supply for fibers to the spinning rotor, which collects the fibers into a yarn. Then, after a predetermined time has passed, the rotation of the draw off rollers, which withdraw the yarn from the spinning rotor, and the winding drum which frictionally rotates the bobbin, and the traverse motion of the traverse guide, which traverses the yarn along the bobbin, are stopped. When the machine is started again, the draw off rollers and the winding drum are first rotated in the direction opposite to the normal rotating direction thereof. This allows the yarn wound around the bobbin to be unwound and the end of the yarn situated in a delivery tube connected to the spinning rotor to be sent back into the spinning rotor.

At the same time fibers are supplied into the spinning rotor by a combing roller so as to facilitate the piecing up of the yarn. After a predetermined time has passed, the draw off rollers and the winding drum are rotated in the normal direction, and the traverse of the traverse guide is simultaneously started, so that the winding of the yarn is commenced.

However, in the above described method, because the yarn is exposed to an excessive yarn tension, yarn breakage may occur frequently between the winding drum and the yarn traverse guide while the draw off rollers and the winding drums are rotated in the direction opposite to the normal rotating direction thereof. The reason for this is as follows. In a so called quick traverse winding system, a traverse guide is moved by a grooved cam, and a pin which slides in the groove of the grooved cam. If the traverse guide is moved in the direction opposite to its normal direction, due to the rotation of the grooved cam in a direction opposite to its normal rotating direction, excessive forces may be generated on the grooved cam or the pin. Therefore, it is not desirable to move the traverse guide utilized in the quick traverse winding system in the direction opposite to its normal direction. To avoid the excessive forces generated on the grooved cam or pin, in many conventional machines the yarn traverse guide is kept at a standstill while the draw off rollers and the winding drum are rotated in the direction opposite to their normal direction. However, this method results in yarn breakages for the following reason. When the traverse guide is stopped while the draw off rollers and the winding drum are rotated in a direction opposite to their normal direction, the position where the yarn is unwound from the cheese to the yarn guide can move away from the yarn guide. This results in the yarn between the yarn traverse guide and the discharging position of the cheese being exposed to an excessively increased tension and breakage of the yarn can occur. Of course, in a case where the discharging position of the cheese moves toward the yarn traverse guide, the yarn tension between the discharging position and the yarn traverse guide will not increase and no yarn breakage will occur.

To eliminate the above-mentioned yarn breakage, some conventional machines are provided with a device for disengaging a yarn from the yarn traverse guide while the draw off rollers and the winding drum are rotated in the direction opposite to their normal direction. However, the machine having such a complicated mechanism may not only be expensive, but also troublesome from the maintenance point of view and, therefore, such a machine is not usually utilized in practical mill operations.

An object of the present invention is to provide an open-end spinning machine and a method of stopping the same, by which the above-mentioned defects can be eliminated.

Another object of the present invention is to provide an open-end spinning machine and a method of stopping the same, by which the increase of tension on the yarn between the yarn traverse guide and the yarn discharging position of the cheese can be maintained within a predetermined range while the draw off rollers and the winding drum are rotated in a direction opposite to their normal rotating direction.

A further object of the present invention is to provide an open-end spinning machine and a method of stopping the same by which the yarn is wound around a certain portion of the cheese when the machine is turned off and comes to a stop.

The above-mentioned and further objects, as well as novel features, of the present invention will more fully apparent from the detailed description of the same, set forth below, with reference to the accompanying drawings. It is to be understood, however, that the drawings are for purposes of illustration only and are not intended as a definition of the limits of the invention.

DETAILED DESCRIPTION OF THE INVENTION

Figure 1:
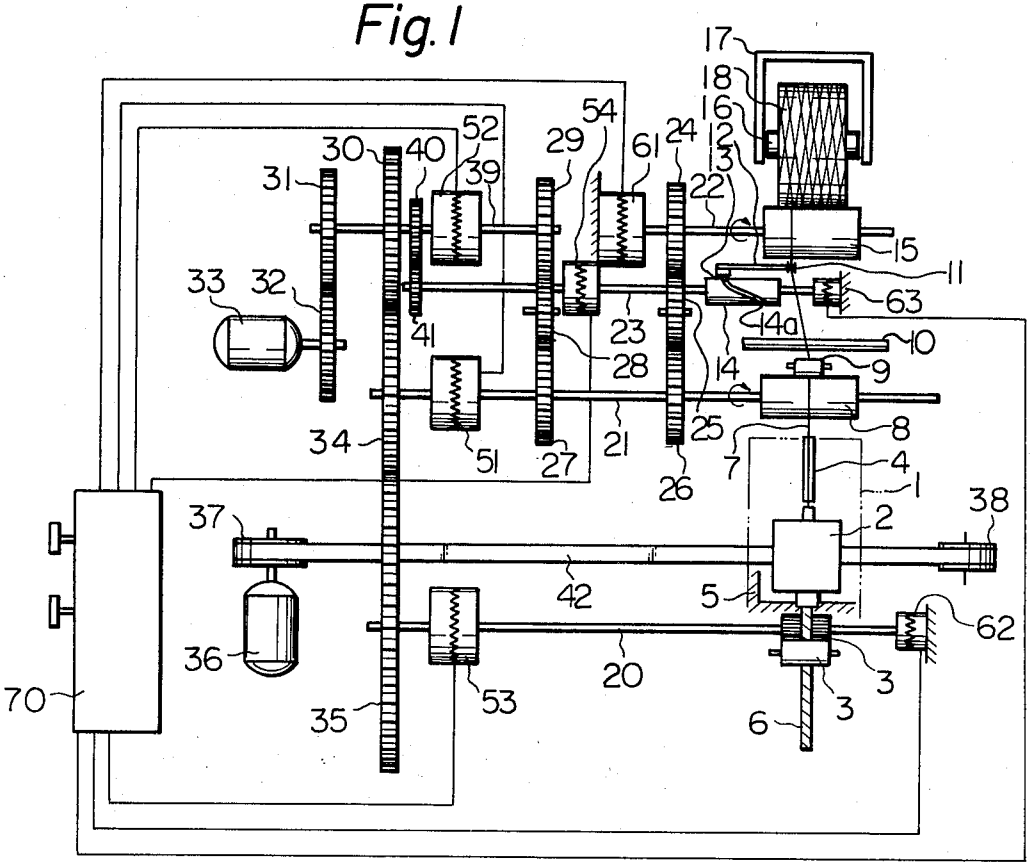
FIG. 1 is a schematic elevational view of an open-end spinning machine for carrying out the method of the present invention.

An open-end spinning machine, according to the present invention is explained hereinafter with reference to the accompanying drawings. Although the open-end spinning machine is usually provided with a plurality of spinning units, an open-end spinning machine which is provided with only one spinning unit, is shown in FIG. 1. Referring to FIG. 1, a spinning unit 1 comprises a spinning rotor 2 rotatably mounted on a frame 5, feed rollers 3 and a delivery tube 4. The feed rollers 3 are utilized for supplying fibers 6 to a combing roller (not shown). The combing roller is rotatably mounted within the spinning unit 1, so as to be rotated with the spinning rotor 2, and is utilized for combing the supplied fibers 6 and for supplying said combed fibers 6 to the spinning rotor 2. The spinning rotor 2 collects the supplied fibers 6 into a yarn 7 and twists the yarn 7. A draw off roller 8, having a press roller 9 swingably mounted thereon, for withdrawing the yarn 6 from the spinning rotor 2 via the delivery tube 4, is provided at a position downstream of said delivery tube 4. A guide bar 10, for guiding the yarn 7, is disposed at a position between the draw off roller 8 and a traverse guide 11 disposed on a traverse rod 12. An end of the traverse rod 12 is provided with a pin 13 which slidably penetrates into a groove 14*a* formed on a surface of a groove roller 14. Consequently the traverse guide 11 is traversed to and fro when the groove roller 14 is rotated. A winding drum 15 is disposed at a position downstream of the traverse guide 11 and is utilized for frictionally rotating a bobbin 16, rotatably mounted on a pair of cradle arms 17, so that the yarn 7 is wound around the bobbin 16 and forms a cheese 18.

Figure 2:
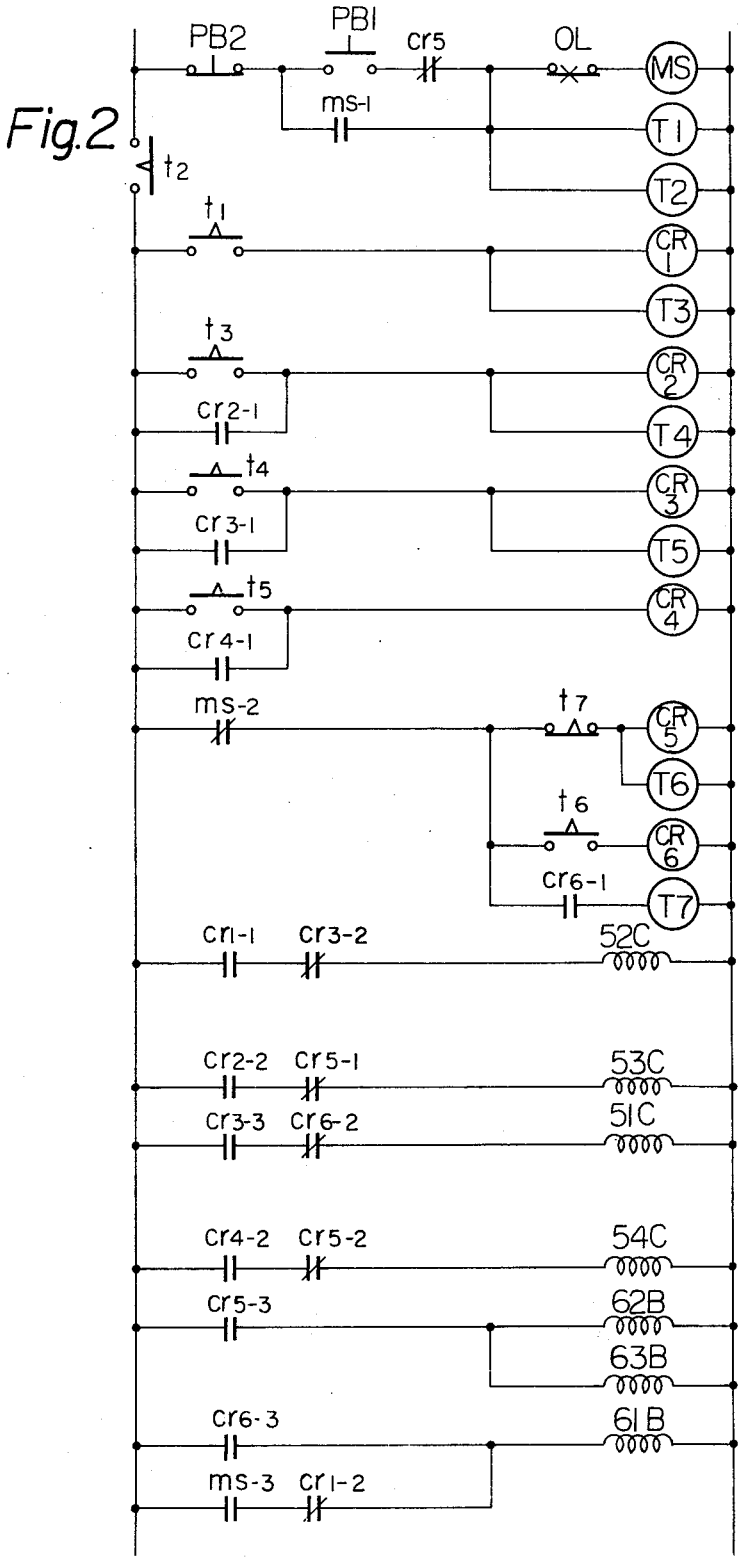
FIG. 2 is a wiring diagram utilized in the machine shown in FIG. 1.

Both a shaft 21 of the draw off roller 8 and a shaft 22 of the winding drum 15 are rotated in the same direction by way of the gear trains 24, 25 and 26. Each of the shafts 21 and 22 is rotatably supported by a bearing (not shown) which is fixed to the frame 5. The two shafts 21 and 22 are driven by an electric motor 33. Each shaft 21, 22 is driven in a normal rotating direction by the motor 33 by way of an electromagnetic clutch 51, which is mounted on the shaft 21. Each shaft 21, 22 is driven by the motor 33 in the reverse rotating direction by way of an electromagnetic clutch 52 which is mounted on a shaft 39. Gear trains 27, 28, 29, 30, 31, 32 and 34 are provided as driving gear trains, but the gear trains 27, 28 and 29 are used only in case it is required to drive the shaft 21 in the reverse rotating direction. A shaft 20 of the feed roller 3 is driven by the gear 34 by way of a gear 35 and an electromagnetic clutch 53. The shaft 20 of the feed roller 3 and the shaft 22 of the winding drum 15 are provided with a magnetic brake 62 and a magnetic brake 61, respectively. The magnetic brakes 61 and 62, and electromagnetic clutches 51, 52 and 53, are controlled by an electric control circuit 70. An electric motor 36 drives the spinning rotor 2 by means of an endless belt 42 which is slidably bridged between a wheel 37, connected to the electric motor 36, and a wheel 38. It should be noted that the endless belt 42 also drives other spinning rotors which belong to respective open-end spinning units; however, other open-end spinning units are not shown in FIG. 1. A shaft 23 of the grooved roller 14, which extends behind the gears 24, 25, 26, 27, 28 and 29, is driven by the motor 33 by way of gear trains 31, 32, 40 and 41, and an electromagnetic clutch 54 mounted on the shaft 23. The shaft 23 of the grooved roller 14 is provided with a magnetic brake 63. The electromagnetic clutch 54 and the magnetic brake 63 are controlled by the electric control circuit 70. The electromagnetic clutches 51, 52, 53 and 54 and the magnetic brakes 61, 62 and 63 include exciting coils 51C, 52C, 53C, 54C, 61B, 62B and 63B (FIG. 2), respectively, for the driving thereof and these exciting coils are wired as shown in FIG. 2.

The electric circuit 70 for controlling the open-end spinning machine is hereinafter explained with reference to the accompanying FIG. 2. In FIG. 2, PB1 designates a push-button switch for starting the operation of the open-end spinning machine of the present invention. PB2 designates a push-button switch for stopping the operation of the open-end spinning machine. MS and ms-1 through ms-3 designate a solenoid coil of a relay and the contacts of the relay, respectively, for starting the main motor 33 (FIG. 1) mechanically connected to feed rollers 3, draw roller 8, groove roller 14 and winding drum 15 via suitable power transmitting means such as gear trains, as shown in FIG. 1, and for starting the motor 36 connected to the spinning rotor 2. T1 through T7 and *t*1 through *t*7 designate time switches and the contacts thereof, respectively. CR1 through CR6 and *cr*1-1 through *cr*6-3 designate solenoid coils of relays and the contacts of the relays, respectively. OL designates a relay switch which operates when an overload current flows.

Figure 3:
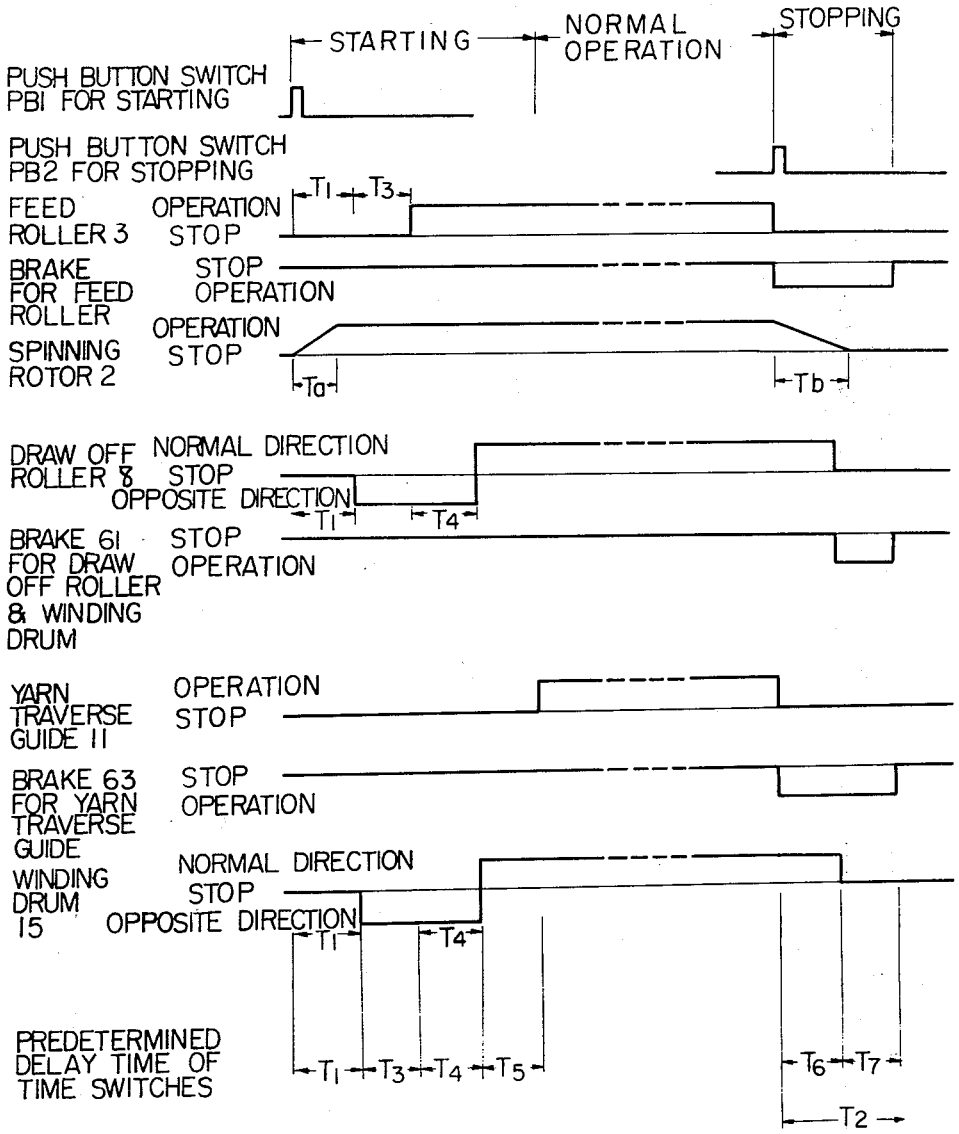
FIG. 3 is an operational diagram of the machine shown in FIG. 1.
Figure 1:
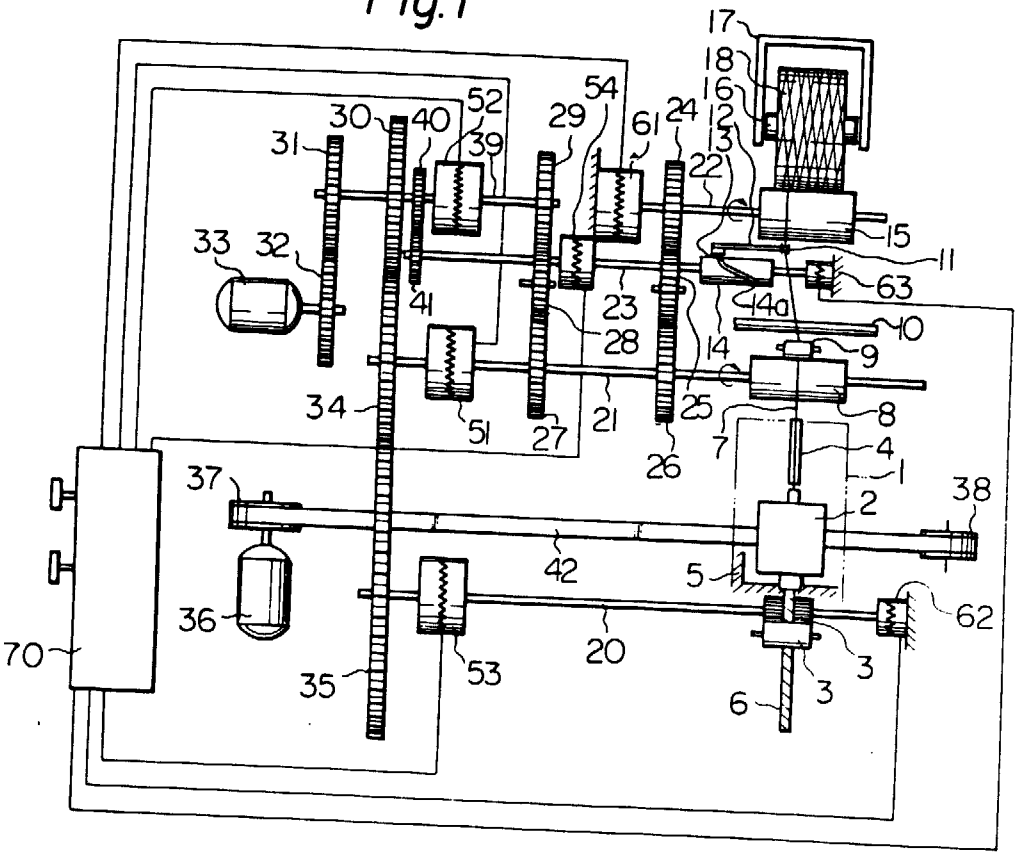

The operation of the open-end spinning machine according to the present invention is hereinafter explained with reference to FIGS. 2 and 3.

A. Starting Operation of the Open-end Spinning Machine (1) When the push-button switch PB1 is pushed, the solenoid coil of the relay MS is excited and the circuits (not shown) of the main motor 33 and motor 36 (FIG. 1) are closed, whereby the main motor 33 and the motor 36 are started. As a result, the spinning rotor 2 and the combing roller (not shown), connected to the motor 36, are rotated up to a normal high speed after a start-up time $T_a$. Since the normal speed of the spinning rotor 2 is significantly higher than that of the other means, the long start-up delay time $T_a$ is generated by the inertia of the spinning rotors 2, while the spinning rotors 2 are sped up. Since the main motor 33 is disconnected from the feed roller 3, the draw off roller 8 and the winding drum 15 at the starting up thereof, the main motor 33 reaches its normal rotating speed in a very short time after the push-button switch PB1 is pushed. At the same time, the circuit comprising the push-button switch PB2, for stopping the open-end spinning machine, the contact *ms*-1 of the relay MS and either the time switch T1 or T2 is closed. Then, the break contact *t*2 of the time switch T2 having a predetermined time delay $T_2$ is closed immediately. For a predetermined delay time $T_1$, which is adjusted to be slightly longer than the start-up time $T_a$, the time switch T1 is energized and is closed.

(2) When the contact *t*1 of the time switch T1 is closed, the solenoid coil of the relay CR1 is energized. Then, the contact *cr*1-1 of the relay CR1 is closed and *cr*1-2 of the relay CR1 is opened and the time switch T3 is energized. Since the contact *cr*1-1 of the relay CR1 is closed, the circuit comprising the contact *cr*1-1, the break contact *cr*3-2 of the relay CR3 and the solenoid coil 52C, of the electromagnetic clutch 52 mounted on the shaft 39, is closed. Because the electromagnetic clutch 52 is connected to the winding drum 15 and the draw off roller 8 via gear trains 24, 25 and 26, for reversely rotating the winding drum 15 and the draw off roller 8, when the above-mentioned circuit including the solenoid coil 52 is closed, the winding drum 15 and the draw off roller 8 are rotated in a direction opposite to their normal rotating direction. As mentioned in item (1) above, when the push-button switch PB1 is pushed, the spinning rotor 2 is rotated. This causes the air pressure within the spinning rotor 2 to be decreased and the yarn 7 becomes slack due to the above-mentioned reverse rotation of the draw off roller 8. Therefore, an end of the yarn (not shown) situated in the delivery tube 4 is caused to move back into the spinning rotor 2 by the above-mentioned decreased air pressure.

(3) After the time switch T3 is energized for a predetermined delay time $T_3$, the make contact *t*3 of the time switch T3 is closed and the solenoid coil of the relay CR2 is energized. When the solenoid coil of the relay CR2 is energized, the circuit comprising the contact *cr*2-2 of the relay CR2, the break contact *cr*5-1 of the relay CR5 and the exciting coil 53C, for driving the clutch 53 connected to the feed roller 3, is closed. Then the feed roller 3 starts to rotate and fibers 6 begin to be supplied into the spinning rotor 2. As a result, the end of yarn and the supplied fibers are pieced up within the spinning rotor 2.

(4) When a predetermined delay time $T_4$ has passed after the close of the make contact *t*3 of the time switch T3 and after the time switch T4 is energized, the time switch T4 is closed and both the solenoid coil of the relay CR3 and time switch T5 are energized. When the solenoid coil of the relay CR3 is energized, the break contact *cr*3-2 opens and the exciting coils 52C become open. In addition, the circuit comprising the contact *cr*3-3 of the relay CR3, the break contact *cr*6-2 of the relay CR6 and the exciting coil 51C for driving the electromagnetic clutch 51, is closed. Then the winding drum 15 and the draw off roller 8 are rotated in their normal rotating direction.

The predetermined delay times $T_3$ and $T_4$ of the time switches T3 and T4 are suitably determined so that the above-mentioned piecing up operation can be carried out and the newly supplied fibers 6 collected in the spinning rotor 2 can be withdrawn from the spinning rotor 2 to the draw off roller 8 and press roller 9.

(5) For a predetermined time $T_5$, the time switch T5 is energized and, then, the time switch T5 is closed for exciting the solenoid coil of the relay CR4. Thereafter, the circuit comprising the contact *cr*4-2 of the relay CR4, the break contact *cr*5-2 of the relay CR5 and the exciting coil 54C for driving the clutch 54 is closed. As a result, the groove roller 14, connected to the clutch 54, starts to rotate in its normal rotating direction. Consequently, the traverse guide 11 is traversed to and fro via the groove roller 14.

The traverse of the traverse guide 11 may be started at any time by adjusting the delay time $T_5$ of the time switch T5. This means the traverse of the traverse guide 11 may even be started just when the draw off roller 8 and the winding drum 15 are started by setting the delay time $T_5$ at zero.

The open-end spinning machine according to the present invention is started and enters into a normal operation as described above.

B. Stopping Operation of the Open-end Spinning Machine (1) When the push-button switch PB2 is pushed, the operation of the solenoid coil of the relay MS for operating the main motor 33 and the motor 36 (FIG. 1) is stopped. Then the main motor 33 is turned off. However, the main motor 33 is at this time connected to the feed roller 3, draw off roller 8 and the winding drum 15, and has a large inertia, and, consequently, the main motor 33 continues its rotation for a while. In addition, when the relay MS is stopped, the motor 36 is turned off and is brought to a standstill after a certain delay time $T_b$. The delay time $T_b$ is generated by the inertia of the spinning rotors 2. The fiber supply, however, is stopped, when the feed roller 3 is stopped, before the spinning rotor 2 is stopped. At the same time, the time switch T2 is energized.

(2) When the solenoid coil of the relay MS is open, the circuit comprising the break contact *ms*-2, break contact *t*7 of the time switch T7, having a predetermined delay time $T_7$, and either the solenoid coil of the relay CR5 or the time switch T6 is closed. Then the solenoid coil of the relay CR5 is energized and the time switch T6 is energized.

(3) When the solenoid coil of the relay CR5 is energized, both the circuit comprising the contact *cr*2-2 of the relay CR2, the break contact *cr*5-1 of the relay CR5 and the exciting coil 53C for driving the clutch 53, and the circuit comprising the contact *cr*4-2 of the relay CR4, the break contact *cr*5-2 of the relay CR5 and the exciting coil 54C for driving the clutch 54 are opened. Then, the driving of the electromagnetic clutch 53 connected to the feed roller 3 and the electromagnetic clutch 54 connected to the groove roller 14, with which the traverse guide 11 is engaged, is stopped. At the same time, the circuit comprising the contact *cr*5-3 and either the exciting coil 62B, for driving the brake 62 connected to the feed roller 3, or the exciting coil 63B, for driving the brake 63 connected to the groove roller 14 with which the traverse guide 11 is engaged, is closed. Then the feed roller 3 and the traverse guide 11 are braked and brought to a standstill.

(4) When the predetermined time $T_6$ has passed after the time switch T6 is energized, the time switch T6 is closed and the circuit comprising the contact *ms*-2 of the relay MS, the contact *t*6 of the time switch T6 and the solenoid coil of the relay CR6, is closed. Then, the solenoid coil of the relay CR6 is energized and the contact *cr*6-1 is closed so that the time switch T7 is energized.

(5) When the solenoid coil of the relay CR6 is energized, the circuit comprising contact *cr*3-3 of the relay CR3, the break contact *cr*6-2 of the relay CR6 and the exciting coil 51C for driving the electromagnetic clutch 51 is opened. Therefore, the electromagnetic clutch 51 connected to the winding drum and the draw off roller 7 becomes open. At the same time, the circuit comprising contact *cr*6-3 and the exciting coil 61B, for driving the magnetic brake 61, is closed. Then, the magnetic brake 61 connected to the winding drum 15 and draw off roller 8 becomes engaged and both the winding drum 15 and the draw off roller 8 are brought to a standstill, while the main motor 33 continues its rotation due to its inertia.

In this case, it is necessary that the delay time $T_6$ of the time switch T6 be adjusted so that it is suitable for the maintaining of the end of the yarn within the delivery tube 4.

(6) When the time switch T7 is energized for the predetermined time $T_7$, the time switch T7 is closed and the solenoid coils of the relays CR5 and CR6, wired to the break contact *t*7, become open. Then the exciting coils 62B, 63B and 61B for driving the magnetic brakes 61, 62 and 63, respectively, become open. The delay time $T_7$ of the time switch T7 is adjusted so that the time switch can be closed after the winding drum 15 and the draw off roller 8 are brought to a complete standstill.

(7) When the predetermined time $T_2$ is passed after the push-button switch PB2 is pushed, the time switch T2 is closed. Then the break contact *t*2 of the time switch T2 is opened and, at that time, all of the holding circuits are open.

The stopping operation of the open-end spinning machine according to the present invention is completed as described above. During the stopping operation of the machine the yarn 7 is wound around the cheese 18 at a certain portion of the cheese 18. This is because, the traverse guide 11 is brought to a standstill before the winding drum 15 and the draw off roller 8 are brought to a standstill, and the yarn 7 fed via the draw off roller 8, the winding drum 15 and the traverse guide 11 is wound around the cheese at the above-mentioned certain portion. Consequently, at the time of restarting the operation of the open-end spinning machine, it is possible to rewind the yarn 7 wound around the above-mentioned certain portion of the cheese 18, so that the yarn tension between the discharging point of the cheese 18 and the traverse guide 11 does not vary and a smooth starting operation can be carried out.

What is claimed is:

1. A method of stopping an open-end spinning machine comprising: feed rollers for supplying fibers to a combing roller so as to comb the fibers, a spinning rotor for collecting said combed fibers into a yarn and for twisting said yarn, a pair of draw off means for withdrawing said yarn from said spinning rotor, a delivery tube disposed at a position between said spinning rotor and said draw off means, a traverse guide for traversing said withdrawn yarn along a bobbin supported by cradle means, and a winding drum for frictionally driving said bobbin to wind said yarn around said bobbin and form a cheese, said method comprising:

a first step of stopping said traverse motion of said traverse guide to bring said traverse guide to a standstill;

a second step of subsequently stopping both said draw off means and said winding drum;

and wherein the interval between said first step and the duration of said second step is adjusted to be sufficient for forming a winding around said cheese at a certain position of said cheese.

2. A method of stopping an open-end spinning machine comprising: feed rollers for supplying fibers to a combing roller so as to comb the fibers, a spinning rotor for collecting said combed fibers into a yarn and for twisting said yarn, a pair of draw off means for withdrawing said yarn from said spinning rotor, a delivery tube disposed at a position between said spinning rotor and said draw off means, a traverse guide for traversing said withdrawn yarn along a bobbin supported by cradle means, and a winding drum for frictionally driving said bobbin to wind said yarn around said bobbin and form a cheese, said method comprising:

a first step of stopping said traverse motion of said traverse guide to bring said traverse guide to a standstill;

a second step of subsequently stopping both said draw off means and said winding drum, and wherein the interval between said first step and said second step is adjusted so as to be sufficient for maintaining an end of said yarn in said delivery tube.

3. An open-end spinning machine comprising:

feed rollers for supplying fibers to a combing roller so as to comb the fibers;

a spinning rotor for collecting said combed fibers into a yarn and for twisting said yarn;

a pair of draw off roller means, for withdrawing said yarn from said spinning rotor, having a first means for engaging with and disengaging from a power source thereof;

a traverse guide for traversing said withdrawn yarn along a bobbin supported by cradle means, said traverse guide being connected to a second means for engaging with and disengaging from a power source thereof;

a winding drum, for frictionally driving said bobbin to wind said yarn around said bobbin and form a cheese, connected to said first means, and;

controlling means, for controlling the above-mentioned two means according to a predetermined program, by which said traverse guide is stopped before both said draw off roller means and said winding drum are stopped.

4. An open-end spinning machine according to claim 3, wherein said feed rollers has a third means for engaging with and disengaging from a power source thereof, and said controlling means controls the above-mentioned three means according to a predetermined program so that said traverse guide is stopped when said feed rollers are stopped.

5. An open-end spinning machine according to claim 3, wherein said traverse guide, and said draw off roller means and said winding drum respectively have braking means so that the stopping operation of the machine is facilitated.

6. An open-end spinning machine according to claim 3, wherein said controlling means comprises a switch (PB2) for actuating a machine stop signal, a relay (CR5) which is energized by said machine stop signal, a time switch (T6), having a predetermined delay time ($T_6$), which is energized by said machine stop signal, and a relay (CR6) which is energized by a signal generated by said time switch (T6) after the time switch (T6) is energized for time ($T_6$), whereby said second means, connected to said traverse guide, is disengaged from said power source by a signal generated by said relay (CR5) and then said first means, connected to both said draw off roller means and said winding drum, is disengaged from said power source by a signal generated by said relay (CR6) after said time switch (T6) is energized for said predetermined delay time ($T_6$).

7. An open-end spinning machine according to claim 6, wherein said controlling means controls means connected to said feed roller so as to disengage said feed roller from said power source by a signal generated by said relay (CR5).

8. An open-end spinning machine according to claim 6, wherein said controlling means controls a brake, connected to both said winding drum and said draw off roller means, and brakes, connected to said traverse guide and said feed roller, respectively, so as to facilitate the stopping operation of the machine.

* * * * *

UNITED STATES PATENT OFFICE

CERTIFICATE OF CORRECTION

Patent No. 4,112,661 Dated September 12, 1978

Inventor(s) Yoshihisa Suzuki, et al

It is certified that error appears in the above-identified patent and that said Letters Patent are hereby corrected as shown below:

In the title page, the indicated drawing is unrelated to the present invention.

There should be utilized, in place thereof, Figure 1 of the instant drawings in this case.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*